US007240399B2

(12) United States Patent
Murayama et al.

(10) Patent No.: US 7,240,399 B2
(45) Date of Patent: Jul. 10, 2007

(54) DOOR CHECKER FOR AUTOMOBILE

(75) Inventors: Yuji Murayama, Sakado (JP); Makiko Honno, Wako (JP)

(73) Assignees: Rikenkaki Kogyo Kabushiki Kaisha, Saitama (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/613,229

(22) Filed: Jul. 7, 2003

(65) Prior Publication Data

US 2004/0075285 A1 Apr. 22, 2004

(30) Foreign Application Priority Data

Jul. 11, 2002 (JP) ..... 2002-202217

(51) Int. Cl.
*E05F 5/02* (2006.01)
*E05C 17/18* (2006.01)

(52) U.S. Cl. ..... 16/82; 16/86 C; 292/265; 292/266

(58) Field of Classification Search ..... 16/86 C, 16/82, 255–257, 344, 262, 85, 86 R, 86 A, 16/86 B; 292/266, 262, 275, DIG. 19
See application file for complete search history.

(56) References Cited

U.S. PATENT DOCUMENTS

| | | | | |
|---|---|---|---|---|
| 4,194,265 | A * | 3/1980 | Zimmermann | 16/82 |
| 4,772,054 | A * | 9/1988 | Schreiber et al. | 292/275 |
| 5,152,030 | A * | 10/1992 | Cogo | 16/86 C |
| 5,173,991 | A * | 12/1992 | Carswell | 16/86 A |
| 5,444,894 | A * | 8/1995 | Heiler | 16/262 |
| 5,474,344 | A * | 12/1995 | Lee | 292/262 |
| 5,862,570 | A * | 1/1999 | Lezuch et al. | 16/82 |
| 6,349,448 | B1 * | 2/2002 | Breed et al. | 16/82 |
| 6,370,733 | B2 * | 4/2002 | Paton et al. | 16/86 C |
| 6,467,126 | B1 * | 10/2002 | Yezersky et al. | 16/86 C |
| 6,687,953 | B1 * | 2/2004 | Liang | 16/86 C |
| 2004/0049882 | A1 * | 3/2004 | Schmoll et al. | 16/82 |

FOREIGN PATENT DOCUMENTS

| | | | |
|---|---|---|---|
| DE | 3642442 | C1 * | 8/1987 |
| FR | 2632902 | * | 12/1989 |
| JP | 58-20059 | | 4/1983 |
| JP | 6-85881 | | 12/1994 |
| JP | 2000-39024 | | 2/2000 |
| JP | 2001-235004 | A1 | 8/2001 |

* cited by examiner

*Primary Examiner*—Robert J. Sandy
*Assistant Examiner*—Andre' L. Jackson
(74) *Attorney, Agent, or Firm*—Arent Fox LLP

(57) ABSTRACT

In a door checker for an automobile, including: a case; a check plate which movably extends through the case and which has on its opposite sides ball guide grooves extending in a lengthwise direction; a pair of ball holders accommodated in the case; a pair of balls which are retained in hemispherical ball housings of the ball holders and which are rollably engaged in the ball guide grooves; and a check spring for biasing the ball holders toward said check plate; and a recess for retaining a grease on an inner surface of each of the ball housings and for accommodating a dust therein is formed in the inner surface of each of the ball housings. Thus, the sticking of the balls due to an entering dust can be prevented, and the smooth rotation and rolling of the balls can be ensured over a long term.

11 Claims, 11 Drawing Sheets

DOOR CHECKER FOR AUTOMOBILE

BACKGROUND OF THE INVENTION

1. Field of the Invention

The present invention relates to a door checker for an automobile, and particularly to an improvement in a door checker for an automobile, comprising: a case secured to one of a body of an automobile and a door pivotally supported on the body for turning movement; a check plate which movably extends through the case to be connected to the other of the body and the door and which is provided in its opposite sides with ball guide grooves extending in a lengthwise direction; a pair of ball holders accommodated in the case and capable of advancing and retracting toward and away from the opposite sides of the check plate; a pair of balls which are retained in hemispherical ball housings formed in the ball holders and which are rollably engaged in the ball guide grooves; and a check spring for biasing the ball holders toward the check plate.

2. Description of the Related Art

A conventional door checker for an automobile is disclosed, for example, in Japanese Utility Model Publication No. 58-20059.

In the conventional door checker for an automobile, the application of a grease to the ball and the ball housing is effective to smooth the rotation of the balls in the ball housings and the rolling of the balls in the ball guide grooves. However, the present inventors found the following disadvantages: if the door checker is used over a long term, dust deposited in each of the ball guide grooves may enter a space between the ball and the ball housing with the rolling of the ball, and the entering dust hinders the rotation of the ball within the ball housing to stick the ball. The ball rubs the ball guide groove without being rolled within the ball guide groove, causing not only an increased resistance to the opening and closing of the door but also an uncomfortable friction noise.

The present invention has been accomplished with such circumstance in view, and it is an object of the present invention to provide a door checker for an automobile, wherein the sticking of the balls due to the entering dust can be prevented, and a smooth rotation and rolling of the balls can be ensured over a long term.

To achieve the above object, according to a first feature of the present invention, there is provided a door checker for an automobile, comprising: a case secured to one of a body of an automobile and a door pivotally supported on said body for turning movement; a check plate which movably extends through said case to be connected to the other of said body and said door and which is provided in its opposite sides with ball guide grooves extending in a lengthwise direction; a pair of ball holders accommodated in said case and capable of advancing and retracting toward and away from the opposite sides of said check plate; a pair of balls which are retained in hemispherical ball housings formed in said ball holders and which are rollably engaged in said ball guide grooves; and a check spring for biasing said ball holders toward said check plate, wherein a recess for retaining a grease on an inner surface of each of said ball housings and for accommodating a dust therein is formed in the inner surface of each of said ball housings.

With the first feature, when the ball is rolled in the ball guide groove while being rotated in the ball housing due to the opening and closing of the door, the surface of the ball is lubricated by the grease retained in the recess in the ball housing, thereby smoothly carrying out the rotation of the ball in the ball housing and the rolling of the ball in the ball guide groove. If a dust deposited to the ball guide groove enters a space between the surface of the ball and the inner surface of the ball housing accompanied by the rotation of the ball, the dust is pushed out and accommodated into the nearby recess by a surface pressure between the ball and a landing portion and a cleaning effect provided by the grease. Consequently, it is possible to prevent a disadvantage that the dust remains adhering to the surface of the ball to stick the ball. Therefore, the smooth rotation and rolling of the ball can be ensured over a long term, and the generation of a friction noise due to the rubbing of the ball guide groove by the ball can be prevented.

According to a second feature of the present invention, in addition to the first feature, the recess has at least portions extending in the lengthwise direction of the ball guide groove through the center of the inner surface of the ball housing.

With the second feature, the lubrication of the ball by the grease and the accommodation of the dust in the recess can be effectively carried out by the rolling of the ball in the ball guide groove in the lengthwise direction.

According to a third feature of the present invention, in addition to the first or second feature, the recess is formed so that its outer end is closed by contact portions between the ball and an inner peripheral surface of the ball housing.

With the third feature, the entrance of the dust into the recess can be minimized by the contact portions between the ball and the inner peripheral surface of the ball housing.

DESCRIPTION OF THE PREFERRED EMBODIMENTS

First, a first embodiment of the present invention shown in FIGS. 1 to 9 will be described.

Figure 1:
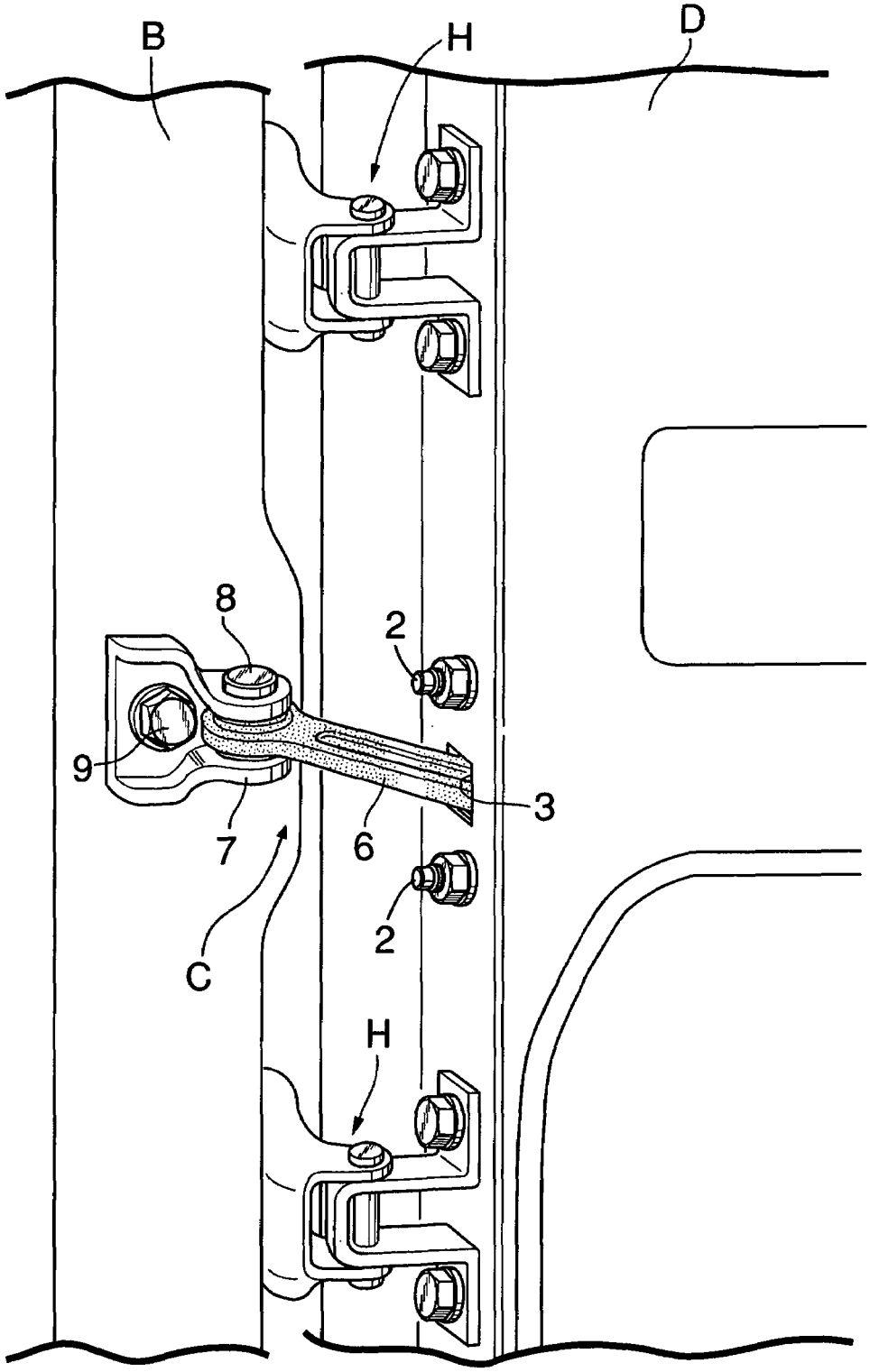
FIG. 1 is a perspective view of essential portions of an automobile provided with a door checker according to a first embodiment of the present invention.
Figure 2:
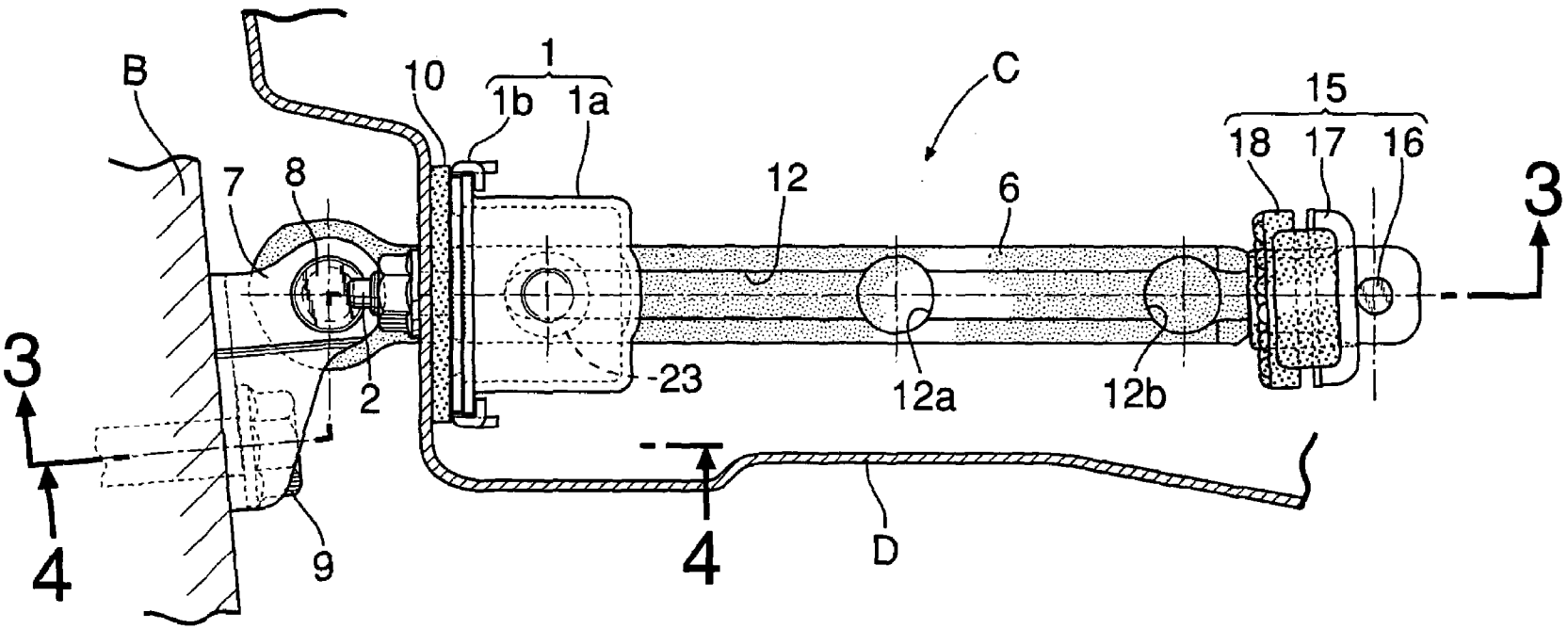
FIG. 2 is a plane view of the door checker.

In FIGS. 1 and 2, a door D is turnable mounted on a body B of an automobile through a pair of upper end lower hinges H to open and close a doorway. A door checker C according to the present invention is mounted between the body B and the door D and between the hinges H.

Figure 3:
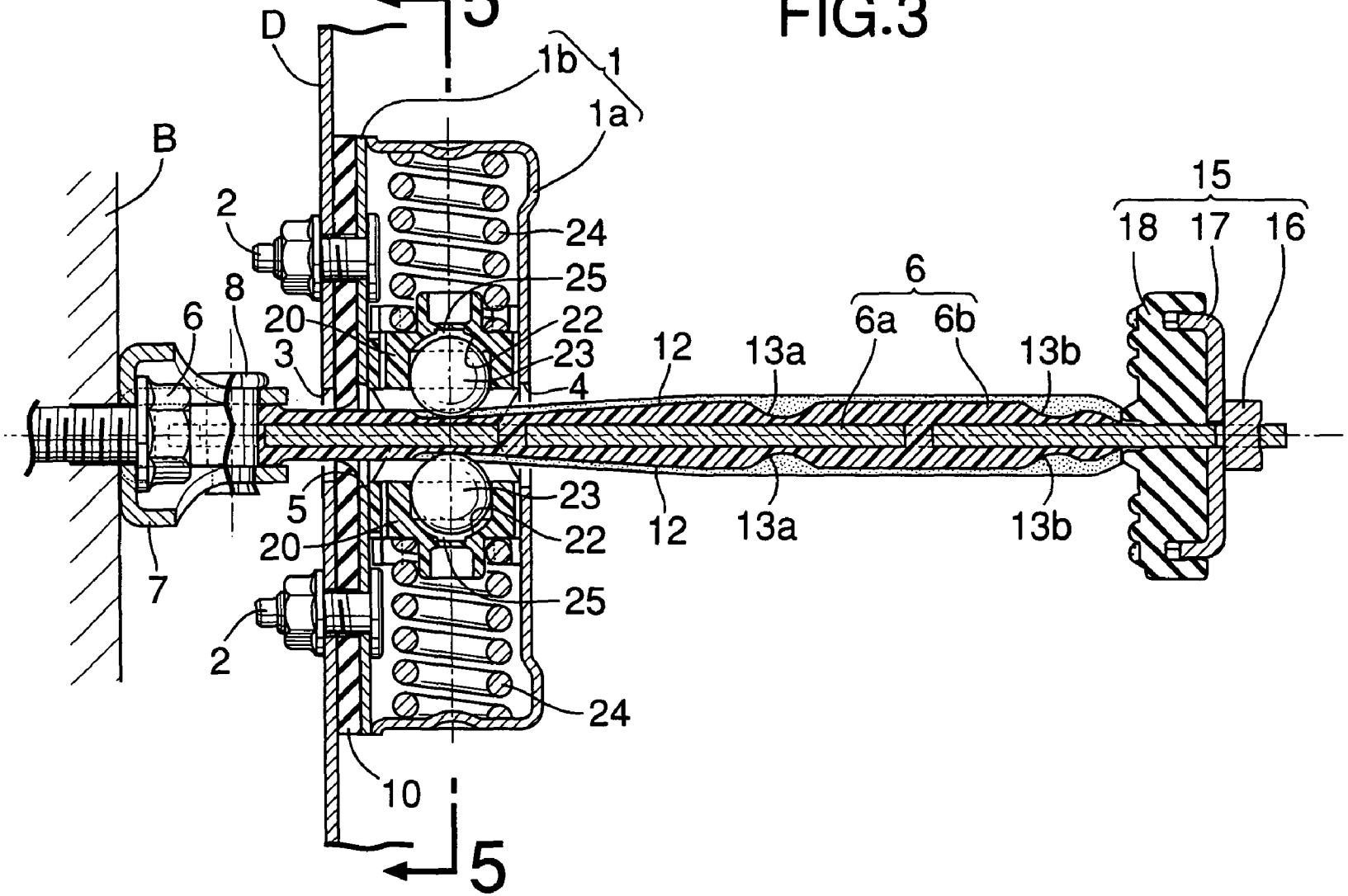
FIG. 3 is a sectional view taken along a line 3—3 in FIG. 2.
Figure 4:
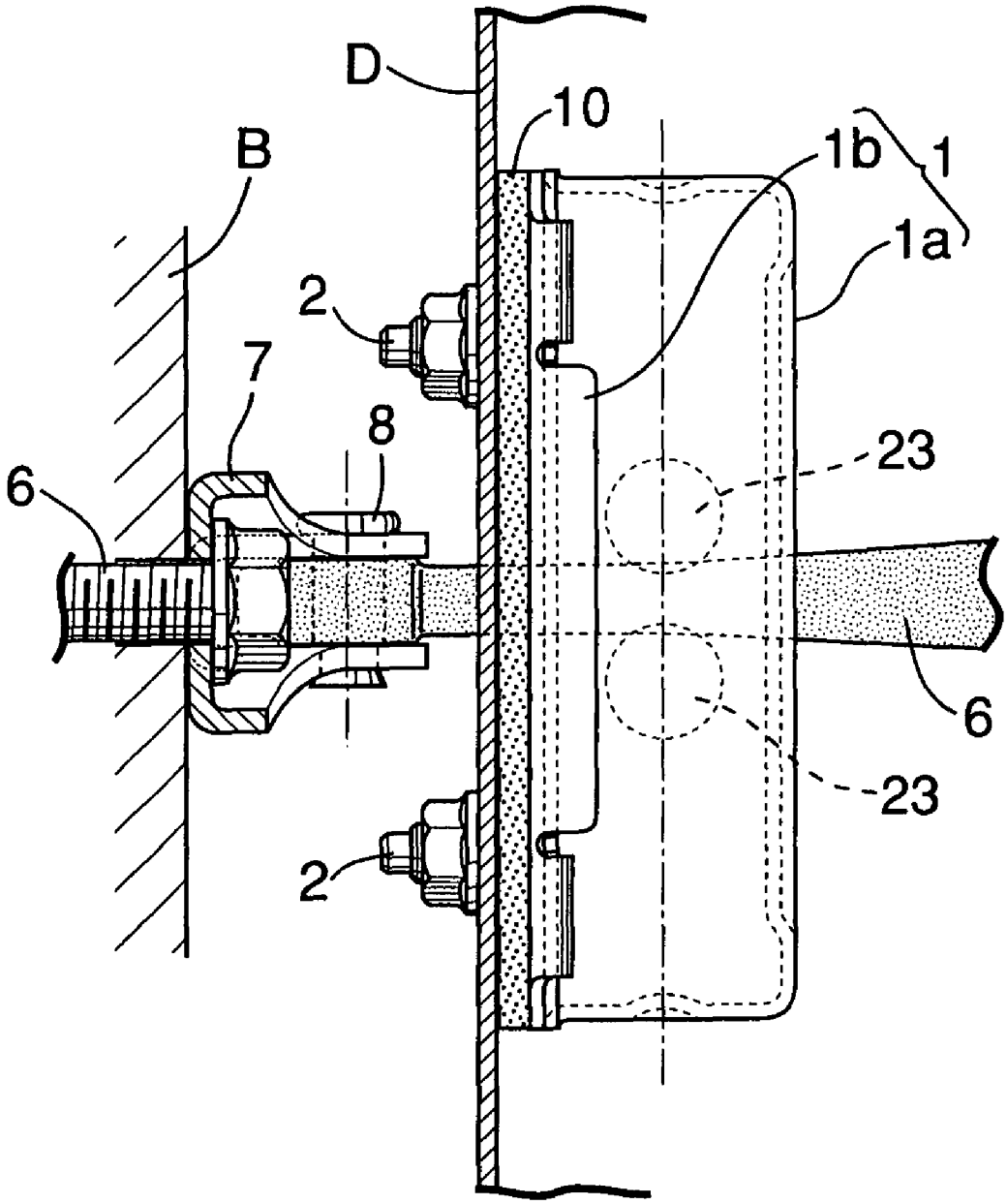
FIG. 4 is a sectional view taken along a line 4—4 in FIG. 2.
Figure 5:
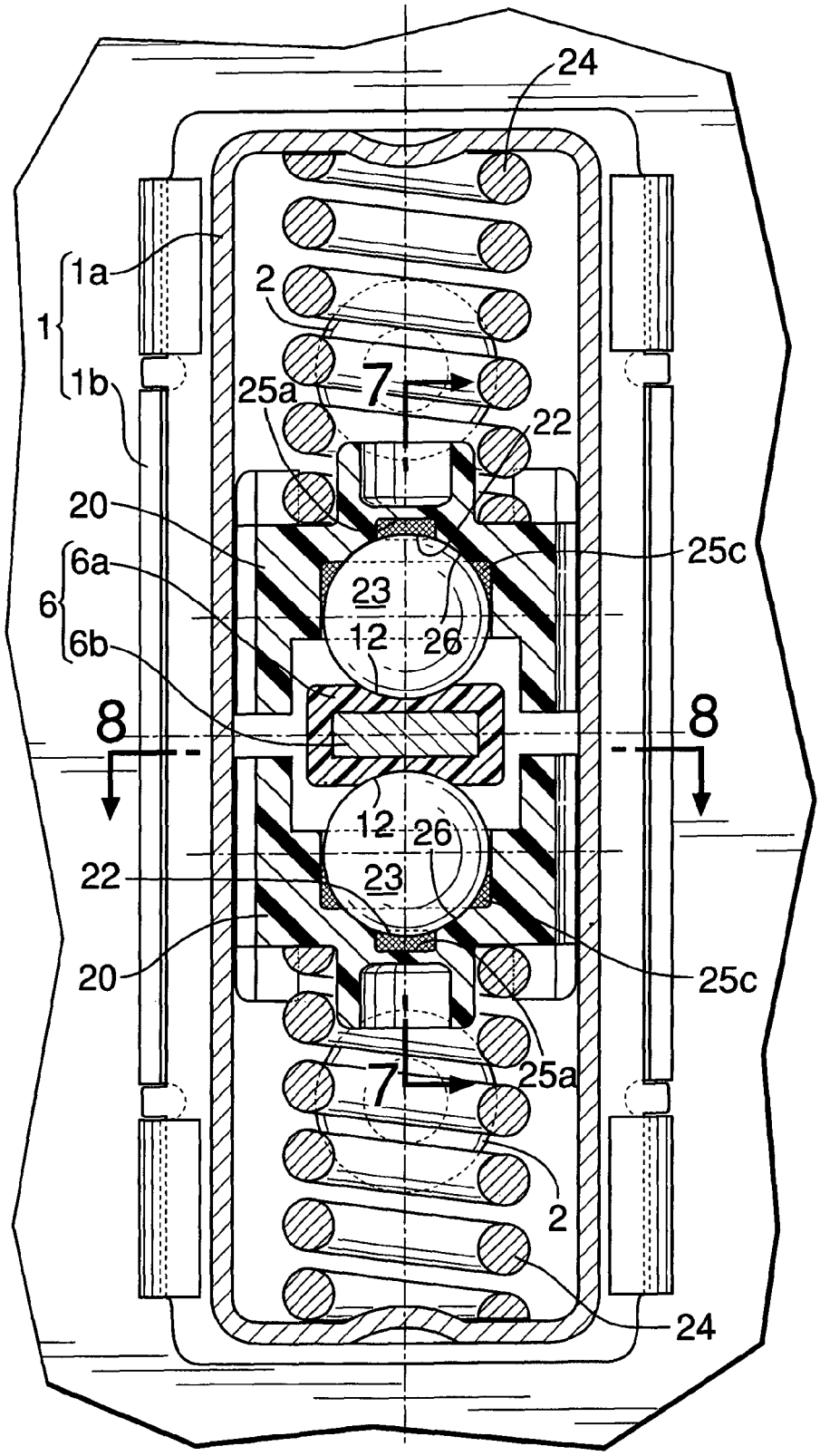
FIG. 5 is a sectional view taken along a line 5—5 in FIG. 3.
Figure 6:
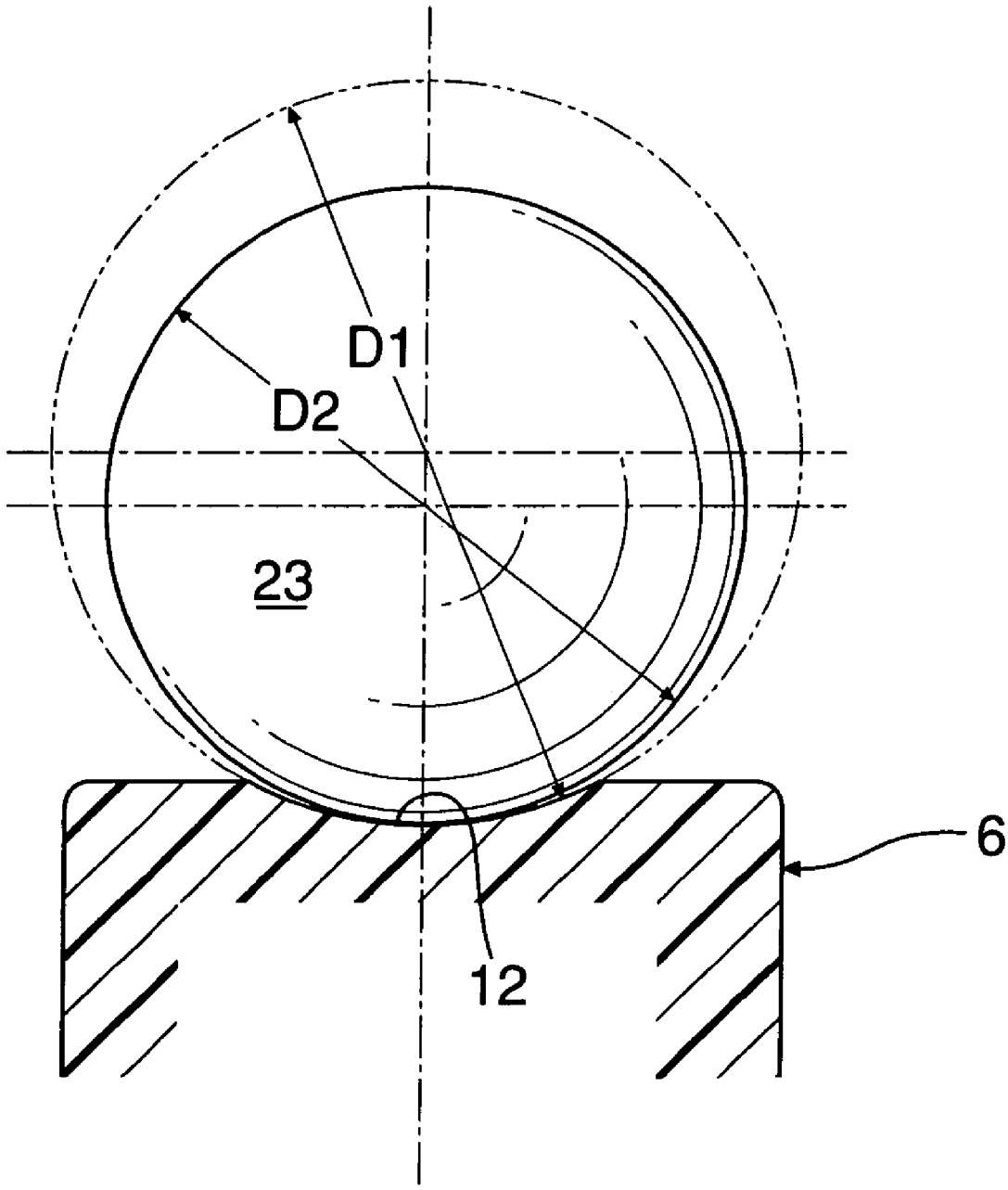
FIG. 6 is an enlarged view of essential portions of FIG. 5.

As shown in FIGS. 3 and 4, the door checker C has a case 1 secured by bolts 2 to an inner surface of and end wall of the door D. The case 1 comprises a box-shaped case body 1*a* opened at one end thereof, and a cover 1*b* coupled to the opened end. The cover 1*b* is secured to an inner wall of the door D by the pair of upper end lower bolts 2. The case body 1*a* and the cover 1*b* have through-bores 4 and 5 which are arranged coaxially with a through-bore 3 which opens into the end wall of the door D. A check plate 6 extends through the three through-bores 3, 4 and 5, and is relatively turnable connected at its base end to a bracket 7 through a pivot 8. The bracket 7 is disposed in parallel to pivots of the hinges H and secured to the body B by a bolt 9. An elastic seal member 10 is clamped between the inner wall of the door D and the case 1 to come into slidable contact with an outer peripheral surface of the check plate 6, so that the entrance of a dust into the case 1 is minimized.

The check plate 6 is comprised of a plate body 6*a* made of a steel and connected to the bracket 7, and a covering portion 6*b* made of a synthetic resin and mold-coupled to an outer surface of the plate body 6*a* excluding its end opposite from the bracket 7. The covering portion 6*b* is formed so that the thickness of the check plate 6 is gradually increased from its base end (the side of the bracket 7) toward its free end. Ball guide grooves 12 arcuate in section are formed in opposite sides of the covering portion 6*b* to extend in a lengthwise direction of the check plate 6, so that balls 23 are rolled on the ball guide grooves 12. Each of the ball guide grooves 12 has a diameter D1 set slightly larger than an outer diameter D2 of the ball 23 (see FIG. 5). A half-opening detent notch 13*a* is formed in a lengthwise intermediate portion of the ball guide groove 12, and a fully-opening detent notch 13*b* is formed in a portion of the ball guide groove 12 in the vicinity of an end opposite from the pivot 8. Each of the detent notches 13*a* and 13*b* has a hemispherical shape having a diameter larger than the width of the ball guide groove 12. The check plate 6 and the ball guide groove 12 are formed rectilinearly in the illustrated embodiment, but may be formed so that it is curved in opening and closing directions of the door D.

A fully-opening stopper 15 is mounted to the plate body 6*a* adjacent the fully-opening detent notch 13*b* to determine the fully opened position of the door D. The fully-opening stopper 15 is comprised of a stopper plate 17 made of a steel and secured to the plate body 6*a* by a pin 16, and a stopper rubber 18 mounted to the stopper plate 17 to shock-absorbingly receive the door.

In FIGS. 6 to 9, a pair of ball holders 20 are received in the case 1 for sliding movement in a thickness-wise direction of the check plate 6, and opposed to opposite sides of the check plate 6. In this case, a projection 21 is integrally formed on one of the sides of each ball holder 20 to resiliently abut against the inner side of the cover 1*b* or the inner side of the case body 1*a* opposite from the inner side of the cover 1*b*, so that the chattering of the ball holder 20 within the case 1 is suppressed. A hemispherical ball housing 22 opens into an end face of each ball holder 20 opposed to the check plate 6. The ball 23 engaged in the ball guide groove 12 is rotatably accommodated in the ball housing 22. A coil-shaped check spring 24 is accommodated in the case 1 for biasing the ball holder 20 in a direction to engage the ball 23 with the ball guide groove.

Figure 7:
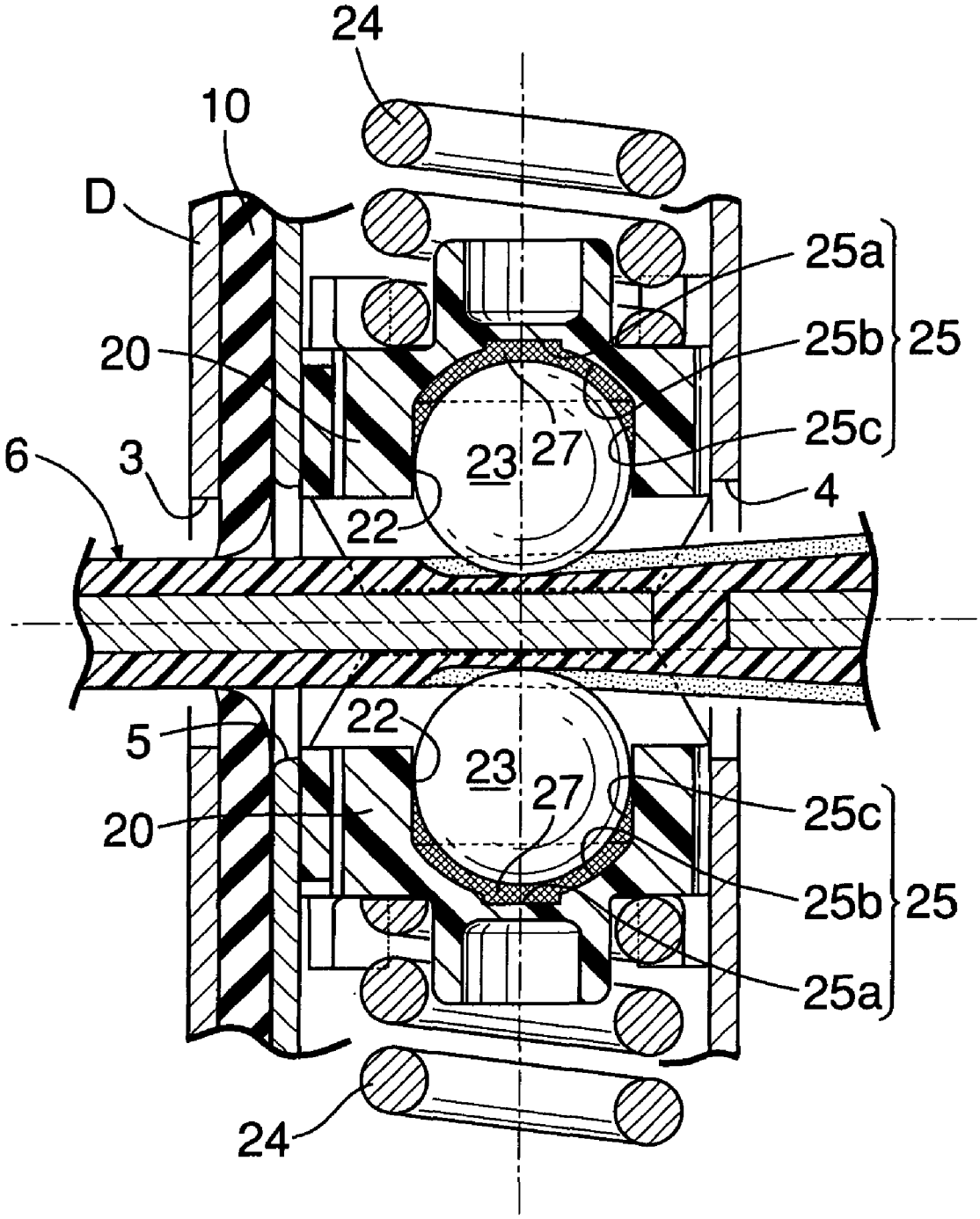
FIG. 7 is a sectional view taken along a line 7—7 in FIG. 5.
Figure 8:
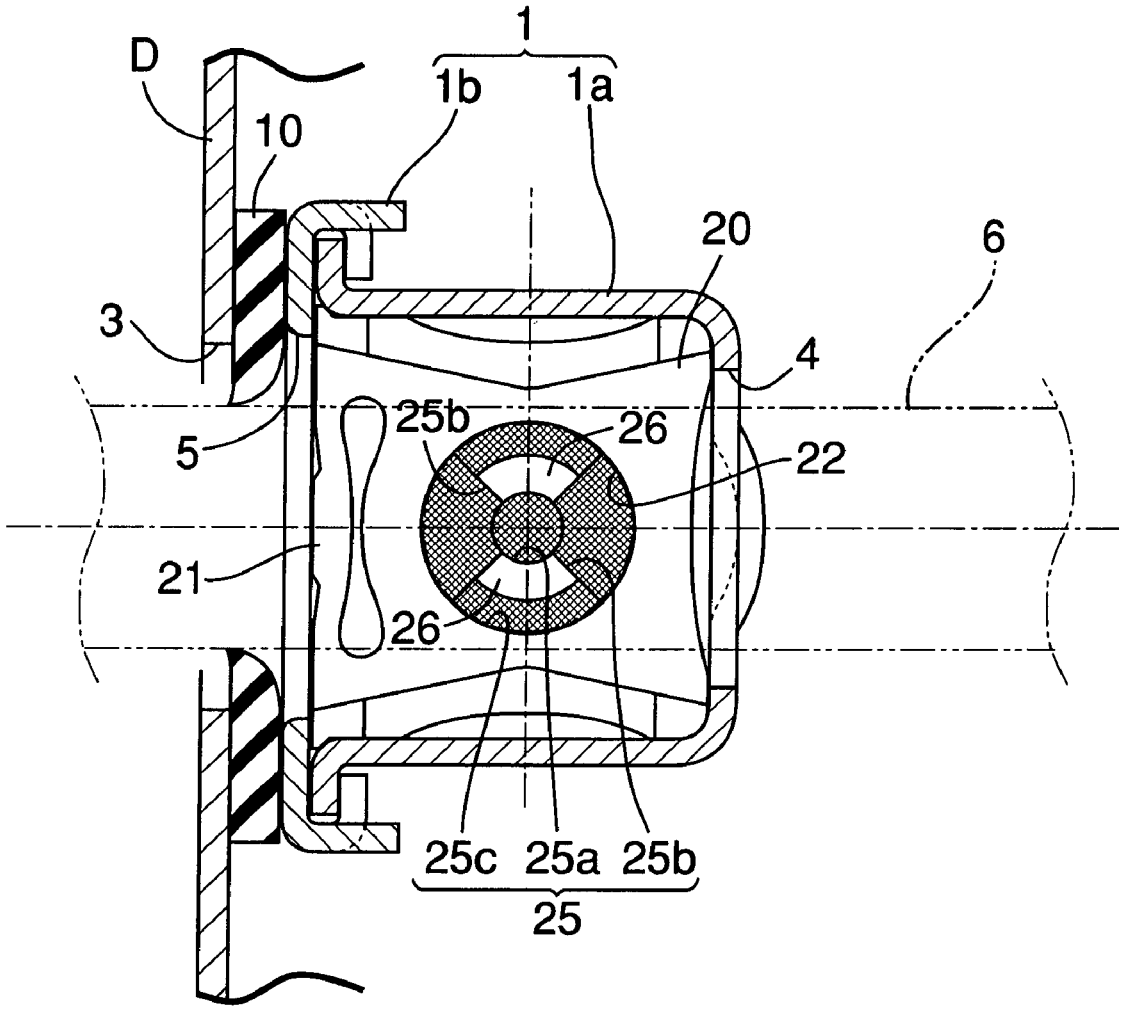
FIG. 8 is a sectional view taken along a line 8—8 in FIG. 5.
Figure 9:
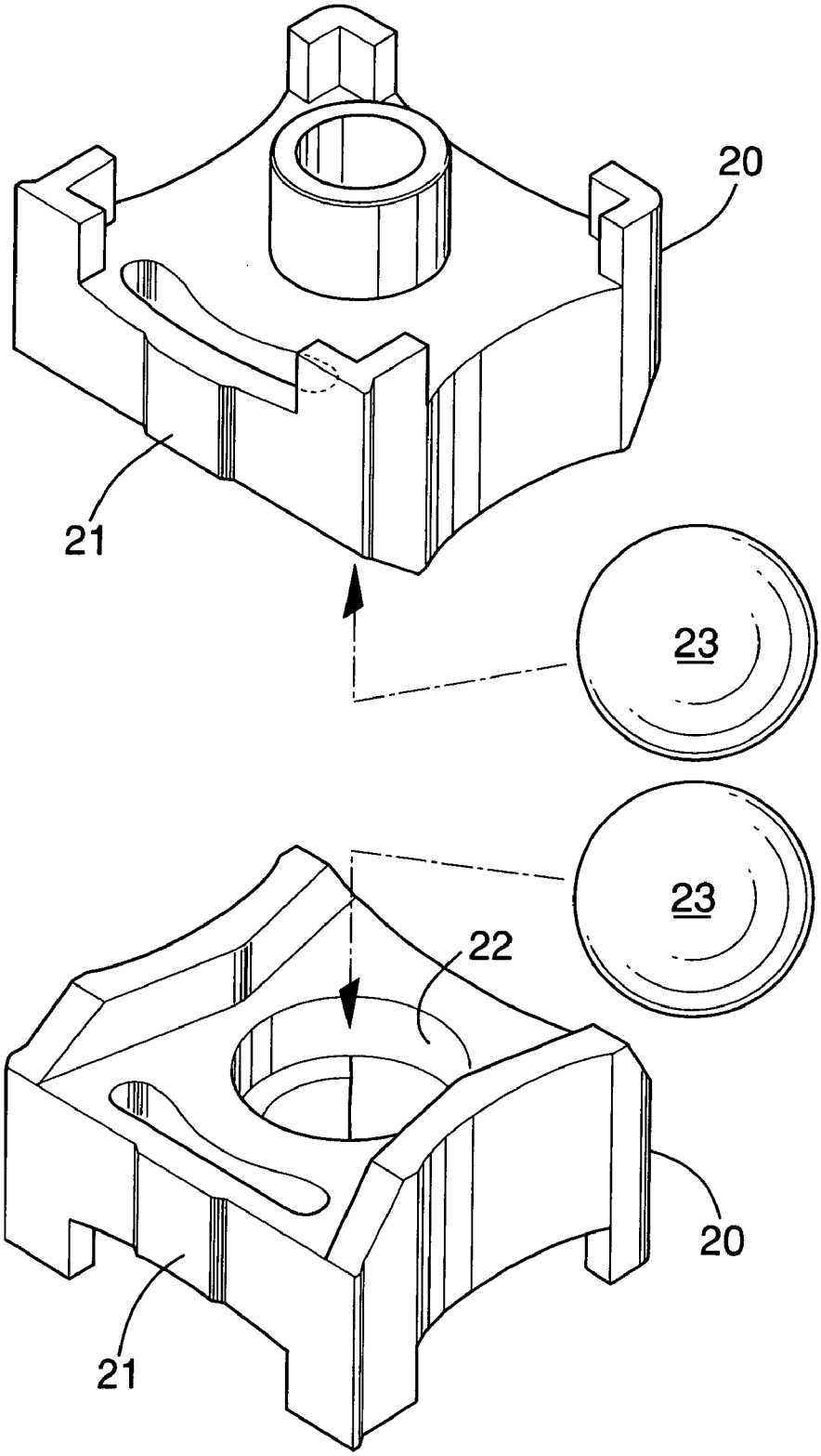
FIG. 9 is an exploded perspective view of essential portions of the door checker.

As clearly shown in FIGS. 7 to 9, a recess 25 retaining a grease 27 therein while accommodating a dust is formed in an inner surface of the ball housing 22. The recess 25 comprises a circular recess portion 25*a* located at the center of the inner surface of the ball housing 22, a pair of fan-shaped grooves 25*b* extending from the circular recess portion 25*a* in the lengthwise direction of the check plate 6, and an annular corner 25*c* which connects outer peripheries of the fan-shaped grooves 25*b* to each other. A pair of arcuate landing portions 26 are left between the annular corner 25*c* and the circular recess portion 25*a*. The recess 25 is formed so that its outer end, i.e., the annular corner 25*c* is closed by contact portions between the ball 23 and an inner peripheral surface of the ball housing 22.

The operation of the first embodiment will be described below.

When the door D is opened from its closed state, the ball 23 is rolled in the ball guide groove 12 in the check plate 6 in a direction of increasing the thickness of the check plate 6, while being rotated in the ball housing 22 of the ball holder 20, whereby the check spring 24 is compressed. Therefore, the clamping force of the balls 23 against the check plate 6 is increased by an increase in resilient force of the check spring 24, whereby the torque for opening the door D is moderately increased.

When the door D is opened to a predetermined half-opened position, the ball 23 is dropped and fitted into the half-opening detent notch 13*a* at the intermediate portion of the ball guide groove 12, so that the door D can be retained at the predetermined half-opened position by the fitting force.

In addition, when an opening force is further applied to the door D to move the ball 23 out of the half-opening detent notch 13*a*, and the door D is opened to a fully-opened position in which the inner wall of the door D abuts against the stopper rubber 18, the ball 23 is dropped into the fully-opening detent notch 13*b* in the check plate 6, so that the door D can be retained at the fully-opened position by the fitting force.

Since the recess 25 retaining the grease 27 is formed in the inner surface of the ball housing 22, the surface of the ball 23 is lubricated by the grease 27 with the rotation of the ball 23 within the ball housing 22. Therefore, the rotation of the ball 23 within the ball housing 22 and the rolling of the ball 23 in the ball guide groove 12 are smoothly carried out. Further, except for the time when the ball 23 is fitted into the detent notches 13*a* or 13*b*, the resistance to the opening and closing of the door D can be decreased and the generation of a friction noise can be prevented.

Moreover, since the annular corner 25*c* at the outer end of the recess 25 is closed by the contact portions between the ball 23 and the inner peripheral surface of the ball housing 22, the entrance of the dust into the recess 25 can be minimized by the contact portions between the ball 23 and the inner peripheral surface of the ball housing 22.

However, if a dust deposited to the ball guide groove 12 enters a space between the surface of the ball 23 and the inner surface of the ball housing 22, for example, the landing portion 26 with rotation of the ball 23, the dust is pushed out and accommodated into the nearer recess 25 by a surface pressure between the ball 23 and the landing portion 26 and a cleaning effect provided by the grease 27. Therefore, it is possible to prevent a disadvantage that the entering dust remains adhering to the surface of the ball 23 or the landing portion 26 of the ball housing 22 to stick the ball 23. Thus, the smooth rotation and rolling of the ball can be ensured for a long term, the generation of a friction noise due to the rubbing of the ball guide groove 12 by the ball can be prevented.

Especially, since the recess 25 includes at least the circular recess portion 25*a* at the center of the inner surface of the ball housing 22, and the fan-shaped grooves 25*b* extending from the circular recess portion 25*a* in the lengthwise direction of the ball guide groove 12, the lubrication of the surface of the ball 23 by the grease 27 and the accommodation of the entering dust into the recess 25 can be effectively carried out every time the ball 23 is rolled in the ball guide groove 12 in the lengthwise direction of the ball guide groove 12. The circular recess 25*a*, the fan-shaped grooves 25*b* and the annular corner 25*c* constituting the recess 25 communicate with one another, and hence the dust accommodated into the recess 25 can be prevented from being accumulated concentratedly at one place, so that the sticking of the ball 23 can be prevented effectively.

A test showed that a grease comprising a synthetic oil as a main component along with solid lubricants such as PTFE and an organic molybdenum, or a silicone grease comprising a silicone oil as a main component is more effectively used as the grease 27 retained in the recess 25 for satisfying both the lubrication of the ball 23 and the prevention of the sticking of the ball 23, as compared with a general-purpose grease containing mineral oil as a main component. The test also showed that the consistency of the grease 27 used is advantageous to be No. 1 or No. 2 defined in NLGI. Namely, when the consistency of the grease 27 is No. 0, the grease is too soft and liable to flow out of the recess 25 relatively early, leading to a possibility that the long-term lubrication is hindered. When the consistency of the grease is No. 3 or more, the grease is too hard and has a poor cleaning effect against dust, so that the dust is liable to adhere to the surface of the ball 23.

Other embodiments will now be described.

Figure 10:
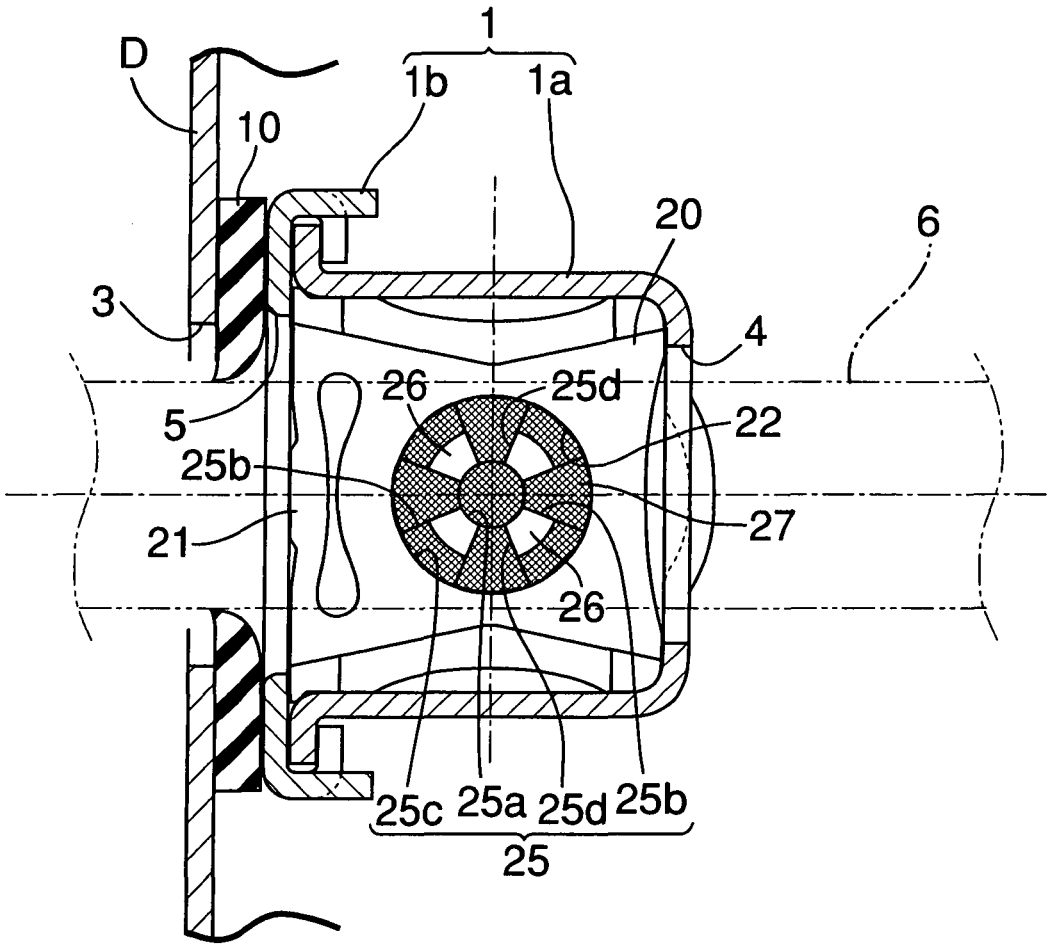
FIG. 10 is a sectional view similar to FIG. 8, but showing a second embodiment of the present invention.

In a second embodiment of the present invention shown in FIG. 10, the recess 25 formed in an inner surface of the ball housing 22 additionally includes a fan-shaped groove 25*d* extending in a widthwise direction of the ball guide groove 12 from the circular recess portion 25*a* at the center to reach the annular corner 25*c*. The structure of the other components is the same as that in the above-described embodiment. Hence, portions or components corresponding to those in the first embodiment are designated by the same reference numerals and symbols in FIG. 10, and the description of them is omitted.

Figure 11:
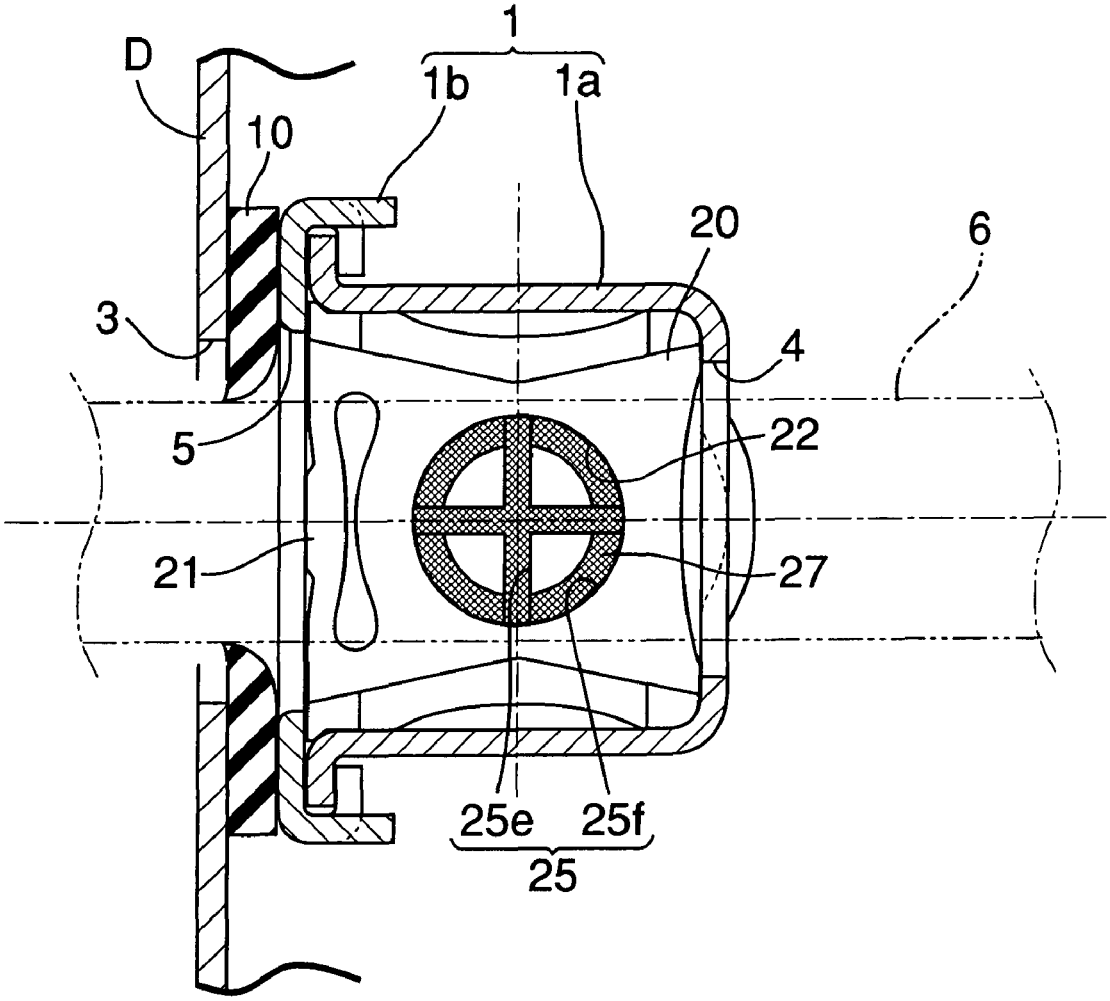
FIG. 11 is a sectional view similar to FIG. 7, but showing a third embodiment of the present invention.

In a third embodiment of the present invention shown in FIG. 11, a recess 25 formed in an inner surface of the ball housing 22 is comprised of a cross-shaped groove 25*e* extending in lengthwise and widthwise directions of the ball guide groove 12 through the center of the inner surface of the ball housing 22, and an annular corner 25*f* which connects outer ends of the cross-shaped groove 25*e* to each other. The structure of the other components is the same as that in the first embodiment. Hence, portions or components corresponding to those in the first embodiment are designated by the same reference numerals and symbols in FIG. 11, and the description of them is omitted.

According to the second and third embodiments, even if the ball 23 is rotated in any direction, the lubrication of the ball 23 by the grease 27 retained in the recess 25 and the accommodation of the entering dust into the recess 25 can be reliably carried out. Therefore, the second and third embodiments are effective particularly when the ball guide groove 12 is formed in a curved manner.

The present invention is not limited to the above-described embodiments, and various modifications in design may be made without departing from the subject matter of the present invention. For example, the case 1 maybe secured to the body B, and the bracket 7 of the check plate 6 may be mounted to the door D. Also, a rubber spring may be used in place of the coil-shaped check spring 24.

Although the embodiments of the present invention have been described in detail above, it will be understood that various modifications in design may be made without departing from the spirit and scope of the invention defined in the claims.

What is claimed is:

1. A door checker for an automobile, comprising:

a case secured to one of a body of an automobile and a door pivotally supported on said body for turning movement;

a check plate which movably extends through said case to be connected to the other of said body and said door and which is provided in its opposite sides with ball guide grooves extending in a lengthwise direction;

a pair of ball holders accommodated in said case and capable of advancing and retracting toward and away from the opposite sides of said check plate, wherein a projection is integrally formed on a side of each ball holder and resiliently abuts against an inner side of the case, the projection being disposed at a center of and extending away from the side of the ball holder in a direction parallel to the ball guide grooves;

a pair of balls which are retained in hemispherical ball housings formed in said ball holders and which are rollably engaged in said ball guide grooves; and check springs for biasing said ball holders toward said check plate, wherein a recess is formed in a hemispherical inner surface of each ball housing and retains a grease within the recess, the recess also accommodates dust therein.

2. A door checker for an automobile according to claim 1, wherein said recess has at least portions extending in the lengthwise direction of said ball guide groove through the center of the inner surface of said ball housing.

3. A door checker for an automobile according to claim 1 or 2, wherein said recess is formed so that its outer end is closed by contact portions between said ball and an inner peripheral surface of said ball housing.

4. A door checker for an automobile according to claim 1, wherein said recess is closed from said ball guide groove by a corresponding ball of said pair of balls being placed in contact with an inner peripheral surface of said ball housing and said recess has a groove that extends between and connects two portions on an outer peripheral surface of the corresponding ball which have different distances from the ball guide groove.

5. A door checker for an automobile according to claim 4, wherein said recess further has an annular portion defined near the ball guide groove.

6. A door checker for an automobile according to claim 5, wherein said recess further has a circular recess portion located at a center of the inner peripheral surface of the ball housing and connected to said annular portion via said groove.

7. A door checker for an automobile, comprising:

a case secured to one of a body of an automobile and a door pivotally supported on said body for turning movement;

a check plate which movably extends through said case to be connected to the other of said body and said door and which is provided in its opposite sides with ball guide grooves extending in a lengthwise direction;

a pair of ball holders accommodated in said case and capable of advancing and retracting toward and away from the opposite sides of said check plate;

a pair of balls which are retained in hemispherical ball housings formed in said ball holders and which are rollably engaged in said ball guide grooves; and check springs for biasing said ball holders toward said check plate, respectively;

wherein a recess is formed in a hemispherical inner surface of each ball housing so as to be depressed inwardly from the inner surface and retains a grease within the recess, the recess also accommodates dust therein, and wherein said recess is formed so that its outer end is closed along a whole periphery thereof by contact portions between said ball and an inner peripheral surface of said ball housing.

8. A door checker for an automobile according to claim 7, wherein said recess has at least portions extending in the lengthwise direction of said ball guide groove through the center of the inner surface of said ball housing.

9. A door checker for an automobile according to claim 7, wherein said recess is closed from said ball guide groove by a corresponding ball of said pair of balls being placed in contact with an inner peripheral surface of said ball housing and said recess has a groove that extends between and connects two portions on an outer peripheral surface of the corresponding ball which have different distances from the ball guide groove.

10. A door checker for an automobile according to claim 9, wherein said recess further has an annular portion defined near the ball guide groove.

11. A door checker for an automobile according to claim 10, wherein said recess further has a circular recess portion located at a center of the inner peripheral surface of the ball housing and connected to said annular portion via said groove.

* * * * *